US007513739B2

(12) United States Patent
Boury et al.

(10) Patent No.: US 7,513,739 B2
(45) Date of Patent: Apr. 7, 2009

(54) COOLING CIRCUITS FOR A TURBOMACHINE MOVING BLADE

(75) Inventors: Jacques Auguste Amedee Boury, Saint Ouen En Brie (FR); Patrice Eneau, Moissy Cramayel (FR); Sylvain Paquin, Ferolles-Atilly (FR)

(73) Assignee: Snecma, Paris (FR)

( * ) Notice: Subject to any disclaimer, the term of this patent is extended or adjusted under 35 U.S.C. 154(b) by 371 days.

(21) Appl. No.: 11/452,971

(22) Filed: Jun. 15, 2006

(65) Prior Publication Data

US 2007/0116570 A1 May 24, 2007

(30) Foreign Application Priority Data

Jun. 21, 2005 (FR) ..... 05 06266

(51) Int. Cl.
*F01D 5/18* (2006.01)

(52) U.S. Cl. ..... 415/115; 415/116; 416/97 R

(58) Field of Classification Search ..... 415/115, 415/116; 416/92, 95, 97 R
See application file for complete search history.

(56) References Cited

U.S. PATENT DOCUMENTS 5,165,852 A * 11/1992 Lee et al. ..... 416/97 R
5,193,980 A 3/1993 Kaincz et al.
5,356,265 A * 10/1994 Kercher ..... 416/97 R
5,387,085 A * 2/1995 Thomas et al. ..... 416/97 R
5,813,835 A 9/1998 Corsmeier et al.
6,830,431 B2 12/2004 Bariaud et al.
7,097,426 B2 * 8/2006 Lee et al. ..... 416/97 R
7,296,972 B2 * 11/2007 Liang ..... 416/97 R
7,296,973 B2 * 11/2007 Lee et al. ..... 416/97 R

FOREIGN PATENT DOCUMENTS

EP 1 362 982 A1 11/2003
JP 60-135606 7/1985

OTHER PUBLICATIONS

U.S. Appl. No. 11/452,971, filed Jun. 15, 2006, Boury, et al.

* cited by examiner

*Primary Examiner*—Igor Kershteyn
(74) *Attorney, Agent, or Firm*—Oblon, Spivak, McClelland, Maier & Neustadt, P.C.

(57) ABSTRACT

A moving blade for a turbomachine, the central portion of the blade including a pressure-side cooling circuit and a suction-side cooling circuit. The pressure-side circuit comprises at least first and second pressure-side cavities extending from the pressure side of the blade to a central wall, a central cavity extending from the pressure side to the suction side of the blade, and outlet orifices opening out from the central cavity and into the pressure-side face of the blade. The suction-side circuit comprises at least first and second suction-side cavities extending radially from the suction side of the blade to the central wall, a central cavity extending across the blade from the pressure side to the suction side, and outlet orifices opening out from the central cavity and into the pressure-side face of the blade.

10 Claims, 4 Drawing Sheets

COOLING CIRCUITS FOR A TURBOMACHINE MOVING BLADE

BACKGROUND OF THE INVENTION

The present invention relates to the general field of cooling the moving blades of a turbomachine, and in particular the blades of the high pressure turbine.

It is known to provide the moving blades of a turbomachine gas turbine, such as the high and low pressure turbines, with internal cooling circuits enabling them to withstand without damage the very high temperatures to which they are subjected while the turbomachine is in operation. Thus, in a high pressure turbine, the temperature of the gas coming from the combustion chamber can reach values well above those that the moving blades of the turbine can withstand without damage, thereby having the consequence of limiting their lifetime.

By using such cooling circuits, air which is generally introduced into the blade via its root, passes through the blade following a path formed by cavities made inside it, prior to being ejected via orifices opening out in the surface of the blade.

Numerous different embodiments of such cooling circuits are in existence. Thus, certain circuits make use of cooling cavities that occupy the entire width of the blade, thus presenting the drawback of limiting the thermal effectiveness of the cooling. In order to mitigate that drawback, other circuits, such as those described in patent documents EP 1 288 438 and EP 1 288 439 propose using edge cooling cavities occupying only one of the sides (pressure side or suction side) of the blade, or both sides, together with a large central cavity between said edge cavities. Although such circuits are effective from a thermal point of view, they remain difficult and expensive to make by molding and the weight of the resulting blade is large.

OBJECT AND SUMMARY OF THE INVENTION

A main object of the present invention is thus to mitigate such drawbacks by proposing a cooling circuit for a moving blade that enables the blade to be cooled effectively without degrading the aerodynamic performance of the turbine, and presenting a manufacturing cost that is low.

To this end, the blade of the invention includes in its central portion a pressure-side cooling circuit and a suction-side cooling circuit. The pressure-side cooling circuit comprises: at least first and second pressure-side cavities extending radially and in the thickness direction of the blade from the pressure side of the blade to a central wall extending radially and along the skeleton direction of the blade; a central cavity extending radially and in the thickness direction of the blade from the pressure side to the suction side of the blade; an air admission opening at one radial end of the first pressure-side cavity for feeding the pressure-side circuit with air; a first passage causing the other radial end of the first pressure-side cavity to communicate with a neighboring radial end of the second pressure-side cavity; a second passage causing the other radial end of the second pressure-side cavity to communicate with a neighboring radial end of the central cavity; and outlet orifices opening out from the central cavity and into the pressure-side face of the blade. The suction-side cooling circuit comprises: at least first and second suction-side cavities extending radially and in the thickness direction of the blade from the suction side of the blade to said central wall; a central cavity extending radially and in the thickness direction of the blade from the pressure side to the suction side of the blade; an air admission opening at one radial end of the first suction-side cavity to feed the suction-side circuit with air; a first passage causing the other radial end of the first suction-side cavity to communicate with a neighboring radial end of the second suction-side cavity; a second passage causing the other radial end of the second suction-side cavity to communicate with a neighboring radial end of the central cavity; and outlet orifices opening out from the central cavity and into the pressure-side face of the blade.

By means of such circuits, it is possible to obtain cooling of the blade that is uniform and effective. The central wall separating the pressure-side cavities from the suction-side cavities is cooled by the air flowing in the pressure and suction-side circuits. This leads to a drop in the mean temperature of the blade, with the direct consequence of increasing the lifetime of the blade. Furthermore, these cooling circuits present no particular problem in terms of fabrication and installation in the turbine.

In an advantageous disposition of the invention, the blade further includes a leading edge cooling circuit comprising at least one cavity extending radially in the vicinity of the leading edge of the blade, at least one air admission orifice opening out into the leading edge cavity, and outlet orifices opening out from said leading edge cavity and into the leading edge of the blade.

In another advantageous disposition of the invention, the blade further includes a trailing edge cooling circuit comprising at least one cavity extending radially in the vicinity of the trailing edge of the blade, at least one air admission orifice opening out into the trailing edge cavity, and air outlet orifices opening out from the trailing edge cavity and into the pressure-side face of the blade.

Preferably, the internal walls of the cavities of the pressure-side and suction-side cooling circuits are provided with flow disturbers for increasing heat transfer along said walls.

BRIEF DESCRIPTION OF THE DRAWINGS

Other characteristics and advantages of the present invention appear from the following description made with reference to the accompanying drawings which show an embodiment having no limiting character. In the figures.

DETAILED DESCRIPTION OF AN EMBODIMENT

Figure 1:
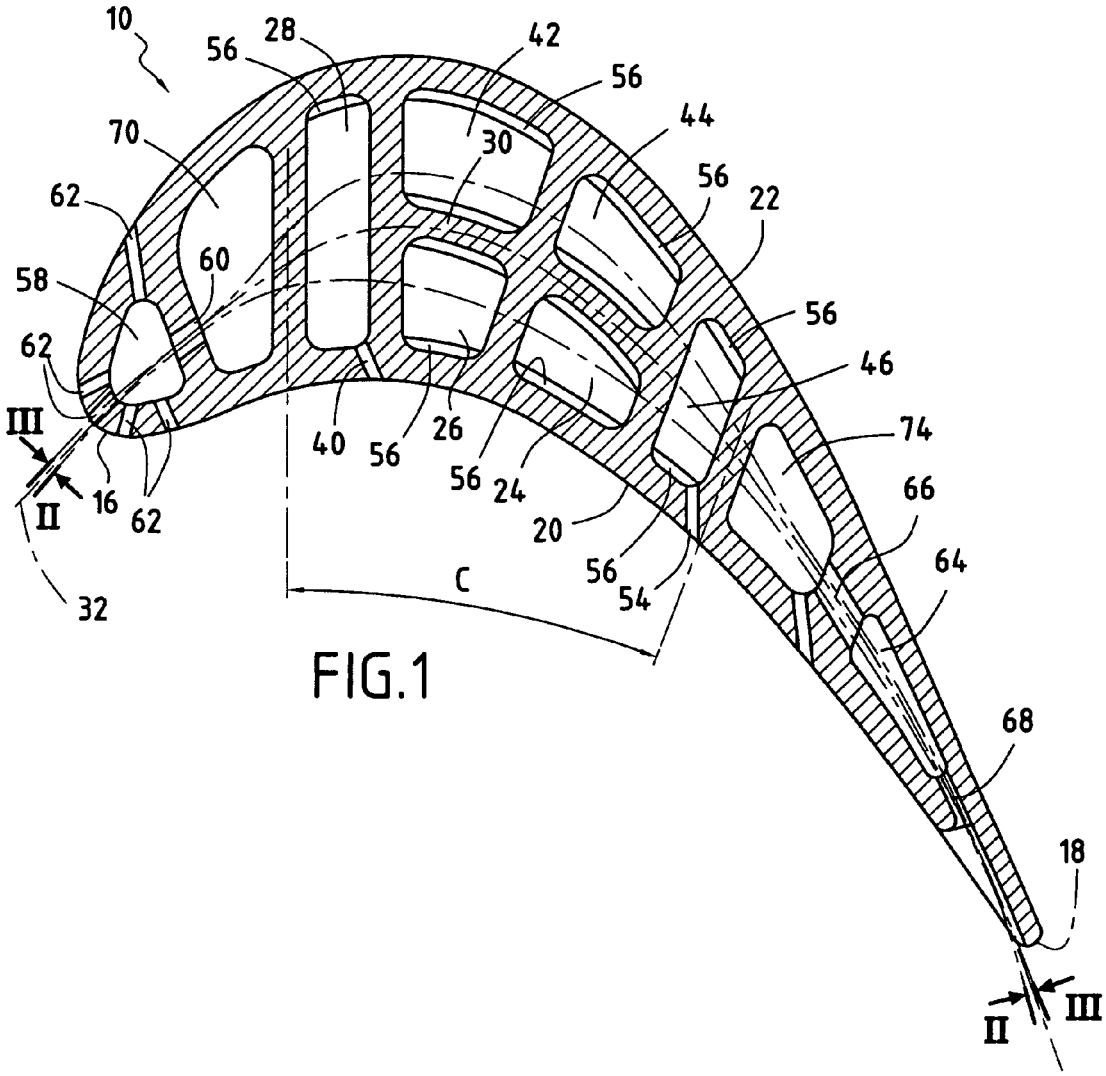
FIG. 1 is a cross-section view of a moving blade constituting an embodiment of the invention.
Figure 2:
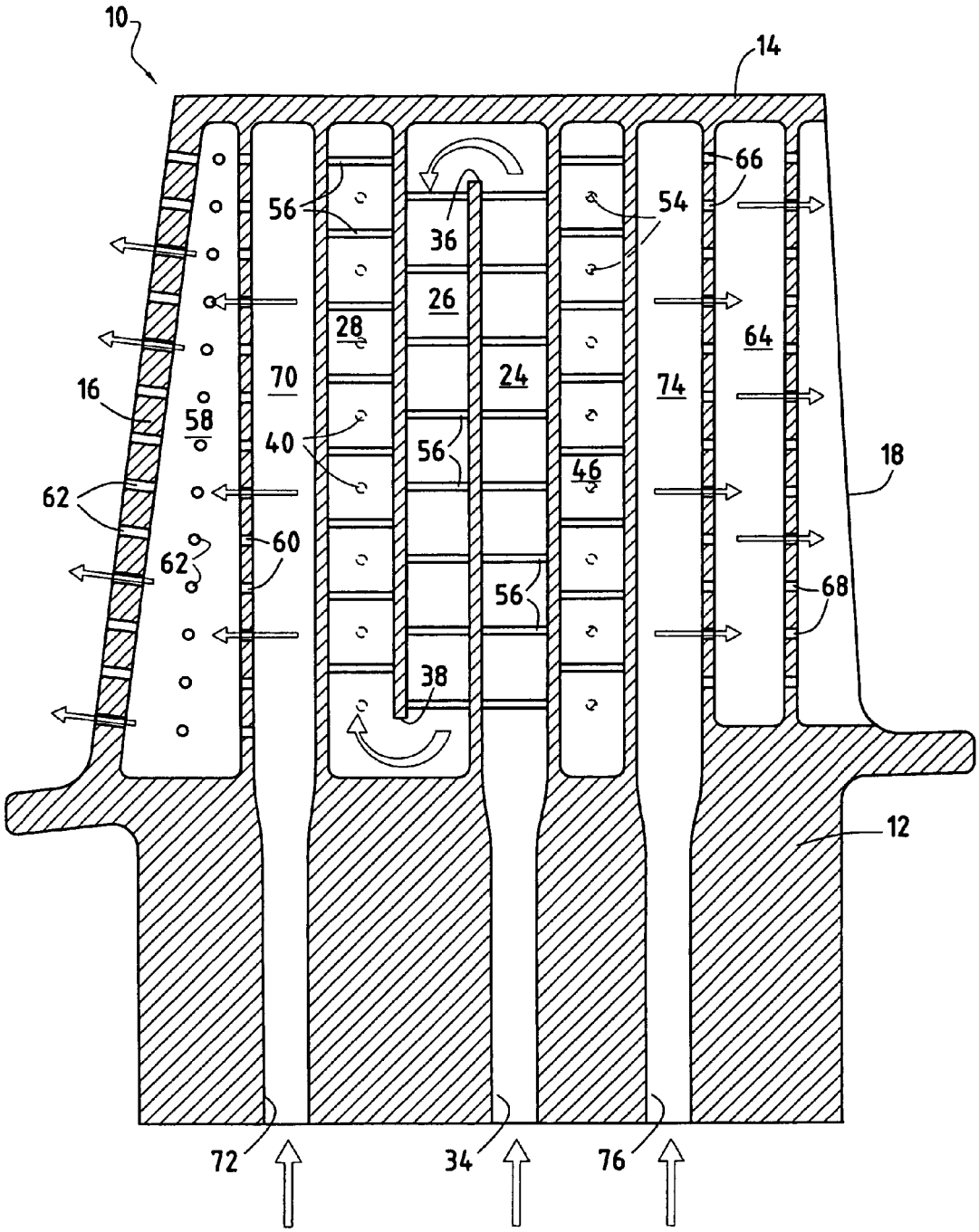
FIGS. 2 and 3 are section views of FIG. 1 taken respectively on II-II and III-III.
Figure 3:
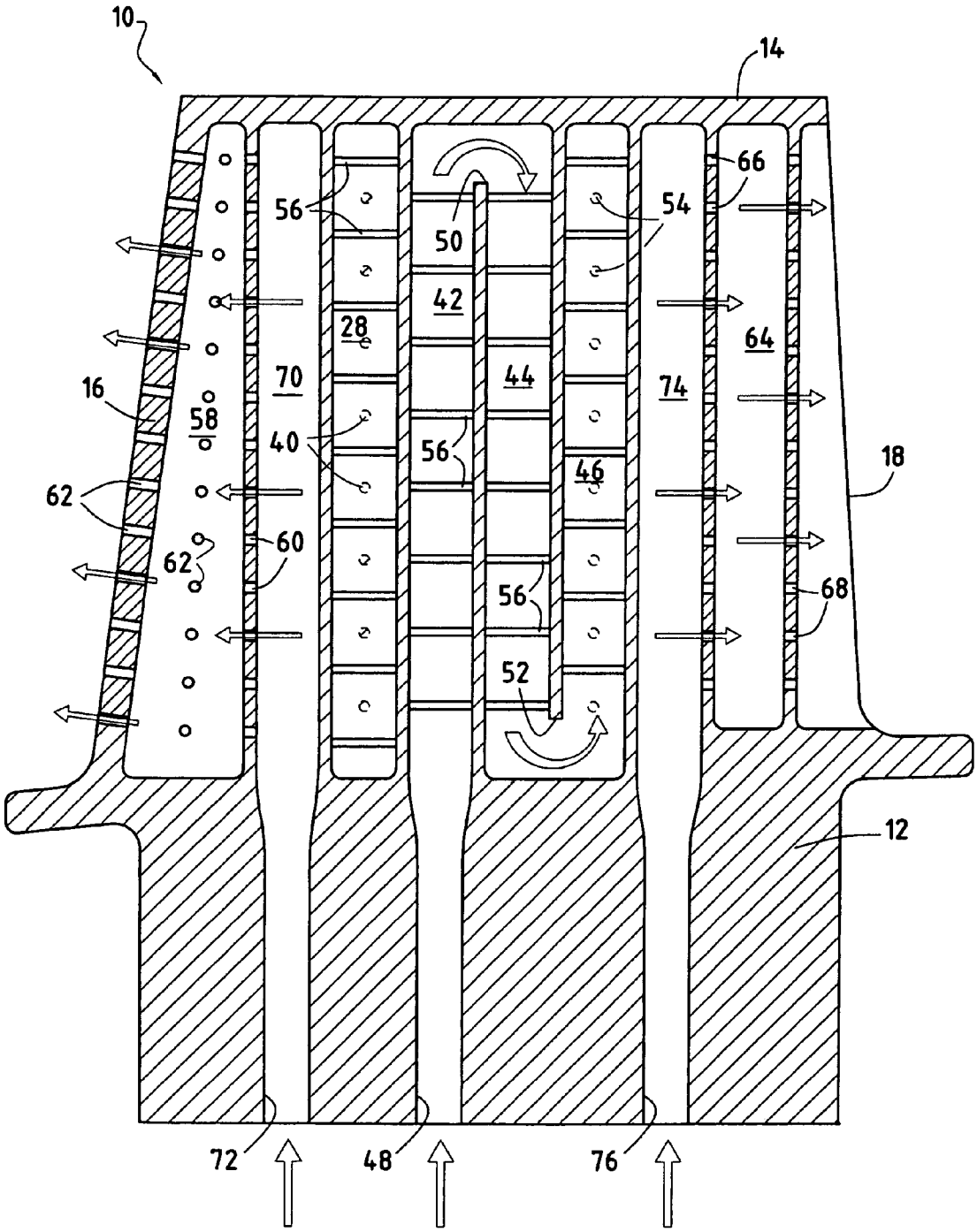

FIGS. 1 to 3 show a moving blade 10 of a turbomachine, such as a moving blade of a high pressure turbine. Naturally, the invention can also be applied to other turbomachine moving blades, for example to the blades of its low pressure turbine.

The blade 10 comprises an aerodynamic surface (or portion) extending radially between a blade root 12 and a blade tip 14. This aerodynamic surface comprises a leading edge 16 placed facing the flow of hot gas coming from the combustion chamber of the turbomachine, a trailing edge 18 opposite from the leading edge 16, a pressure-side face 20, and a suction-side face 22, these side faces 20 and 22 interconnecting the leading edge 16 and the trailing edge 18.

The moving blade 10 of the turbomachine of the invention includes in its central portion C, i.e. in its portion where the distance between its pressure-side and suction-side faces 20 and 22 is the greatest, a pressure-side cooling circuit and a suction-side cooling circuit.

The pressure-side cooling circuit of the blade comprises in particular at least first and second pressure-side cavities 24 and 26 and a central cavity 28 (it is quite possible to envisage having a larger number of pressure-side cavities). The cavities 24, 26, and 28 extend radially between the root 12 and the tip 14 of the blade.

Furthermore, the pressure-side cavities 24 and 26 extend in the thickness direction of the blade from the pressure-side face 20 to a central wall (or partition) 30 extending firstly radially between the root 12 and the tip 14 of the blade, and secondly along the skeleton 32 of the blade. The central cavity 28 extends in the thickness direction of the blade from its pressure-side face 20 to its suction-side face 22.

With reference to FIG. 2, the pressure-side cooling circuit also has an air admission opening 34 at one radial end of the first pressure-side cavity 24 (in this case in the root 12 of the blade) in order to feed the pressure-side circuit with air.

A first passage 36 makes the other radial end of the first pressure-side cavity 24 (i.e. at the tip 14 of the blade) communicate with a neighboring radial end of the second pressure-side cavity 26. A second passage 38 causes the other radial end of the second pressure-side cavity 26 (i.e. at the root 12 of the blade) to communicate with the adjacent radial end of the central cavity 28 of the pressure-side circuit.

The pressure-side cooling circuit also has outlet orifices 40 opening out from the central cavity 28 through the pressure-side face 20 of the blade. These orifices 40 are regularly distributed over the full radial height of the blade.

The path followed by cooling air traveling along this pressure-side circuit can be understood in obvious manner from the above. The circuit is fed with cooling air via the admission opening 34. The air travels initially along the first pressure-side cavity 24 and then along the second pressure-side cavity 26, and finally along the central cavity 28 prior to being exhausted through the pressure side 20 of the blade via the outlet orifices 40.

The suction-side cooling circuit of the blade comprises in particular at least first and second suction-side cavities 42 and 44, and a central cavity 46 (it is quite possible to envisage a larger number of suction-side cavities). The cavities 42, 44, and 46 extend radially between the root 12 and the tip 14 of the blade.

In addition, the suction-side cavities 42, 44 extend across the thickness of the blade from the suction-side face 22 of the blade to the central wall 30 defined above with reference to the pressure-side cooling circuit of the blade. The central cavity 46 occupies the entire thickness of the blade between its pressure-side face 20 and its suction-side face 22.

As shown in FIG. 3, the suction-side cooling circuit also has an air admission opening 48 at a radial end of the first suction-side cavity 42 (in this example in the root 12 of the blade) in order to feed the suction-side circuit with air.

A first passage 50 causes the other radial end of the first suction-side cavity 42 (i.e. at the tip 14 of the blade) to communicate with a neighboring radial end of the second suction-side cavity 44. A second passage 52 causes the other radial end of the second suction-side cavity 44 (i.e. at the root 12 of the blade) to communicate with a neighboring radial end of the central cavity 46 of the suction-side circuit.

The suction-side cooling circuit also has outlet orifices 54 opening out from the central cavity 46 into the pressure-side face 20 of the blade. These orifices 54 are regularly distributed along the entire radial height of the blade.

The path followed by cooling air traveling along this suction-side circuit can be understood in obvious manner from the above. The circuit is fed with cooling air through the admission opening 48. The air begins by traveling along the first suction-side cavity 42 and then along the second suction-side cavity 44 and finally along the central cavity 46 prior to being exhausted through the pressure side 20 of the blade via the outlet orifices 54.

It should be observed that the pressure-side and suction-side cooling circuits have respective air admission openings and that there is no air communication from one of the circuits to the other, such that these circuits are completely independent of each other.

It should also be observed that the pressure-side cavities 24 and 26 and the suction-side cavities 42 and 44 of the pressure-side and suction-side cooling circuits are disposed on either side of the central wall 30. In addition, the central cavity 28 of the pressure-side circuit is situated adjacent to the leading edge 16 of the blade, while the central cavity 46 of the suction-side circuit is located beside the trailing edge 18 of the blade.

As shown in FIGS. 1 to 3, the internal walls of the cavities 24, 26, 28, 42, 44, and 46 of the pressure-side and suction-side cooling cavities are advantageously provided with flow disturbers 56 for increasing heat transfer along these walls.

These flow disturbers may be in the form of ribs that are rectilinear or that slope relative to the axis of rotation of the blade, or they may be in the form of pegs, or in any other equivalent form.

Additional cooling circuits serve to cool the leading edge 16 and the trailing edge 18 of the blade.

In general, the leading edge cooling circuit comprises at least one cavity 58 extending radially in the vicinity of the leading edge 16 of the blade, at least one air admission orifice 60, 60' opening out into the leading edge cavity 58, and outlet orifices 62 opening out from the leading edge cavity and into the leading edge of the blade.

The trailing edge cooling circuit comprises at least one cavity 64 extending radially in the vicinity of the trailing edge 18 of the blade, at least one air admission orifice 66, 66' opening out into the trailing edge cavity 64, and outlet orifices 68 opening out from the trailing edge cavity through the pressure-side face 20 of the blade.

Variant embodiments of these additional cooling circuits are described below.

In the embodiment of FIGS. 1 to 3, the leading edge cooling circuit comprises a central cavity 70 extending radially between the root 12 and the tip 14 of the blade and across the blade from the pressure side 20 to the suction side 22 thereof. An air admission opening 72 is provided at one radial end of this central cavity 70 (in this example in the root 12 of the blade).

The leading edge circuit also includes a plurality of air admission orifices 60 distributed along the full height of the blade. These orifices open out from the central cavity 70 and lead into the leading edge cavity 58.

Thus, cooling air travels along the central cavity 70 and then into the leading edge cavity 58 prior to being exhausted through the leading edge 16 of the blade via the outlet orifices 62. As shown in FIG. 1, air can also be exhausted through the pressure side 20 and the suction side 22 of the blade.

Still in the embodiment of FIGS. 1 to 3, the trailing edge cooling circuit further comprises a central cavity 74 extending radially across the blade from the pressure side 20 to the suction side 22 of the blade, and an opening 76 at one radial end of the central cavity 74 (in this case in the root 12 of the blade) for feeding the circuit with air.

A plurality of air admission orifices 66 distributed along the entire height of the blade open out from the central cavity 74 of this circuit into the trailing edge cavity 64.

The path followed by air in this trailing edge cooling circuit is similar to that of the leading edge circuit: air travels along the central cavity 74 and then along the trailing edge cavity 64 prior to being exhausted through the pressure-side face 20 of the blade near the trailing edge 18 thereof.

Figure 4:
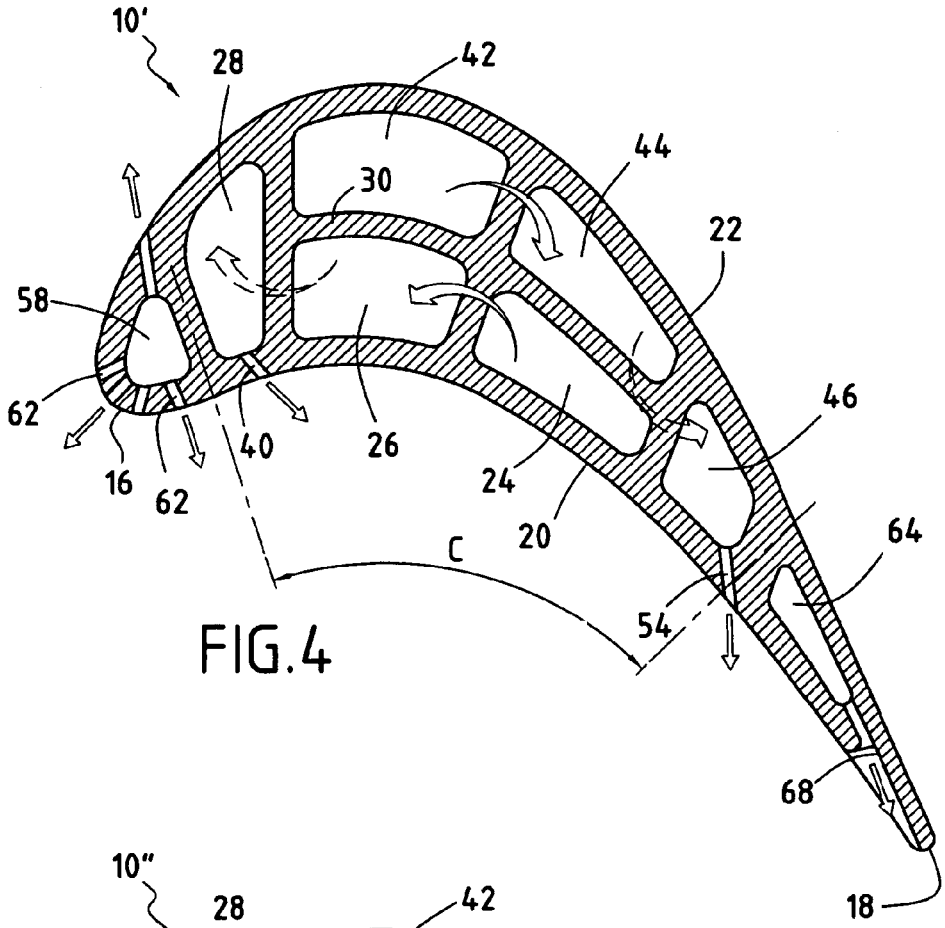
FIGS. 4 and 5 are cross-section views of moving blades constituting other embodiments of the invention.

In another embodiment shown in FIG. 4, the air admission orifices of the leading edge and trailing edge circuits of the blade 10' are openings situated at the respective radial ends of the leading edge and trailing edge cavities 58 and 64 (specifically in the root 12 of the blade) and opening out into said cavities. These air admission orifices are not shown in FIG. 4, but they are of the same type as those feeding the pressure-side and suction-side cooling circuits of the blade.

The cooling air thus travels along the leading edge and trailing edge cavities 58 and 64 from the root 12 towards the tip 14 of the blade prior to being exhausted via respective outlet orifices 62, 68.

Figure 5:
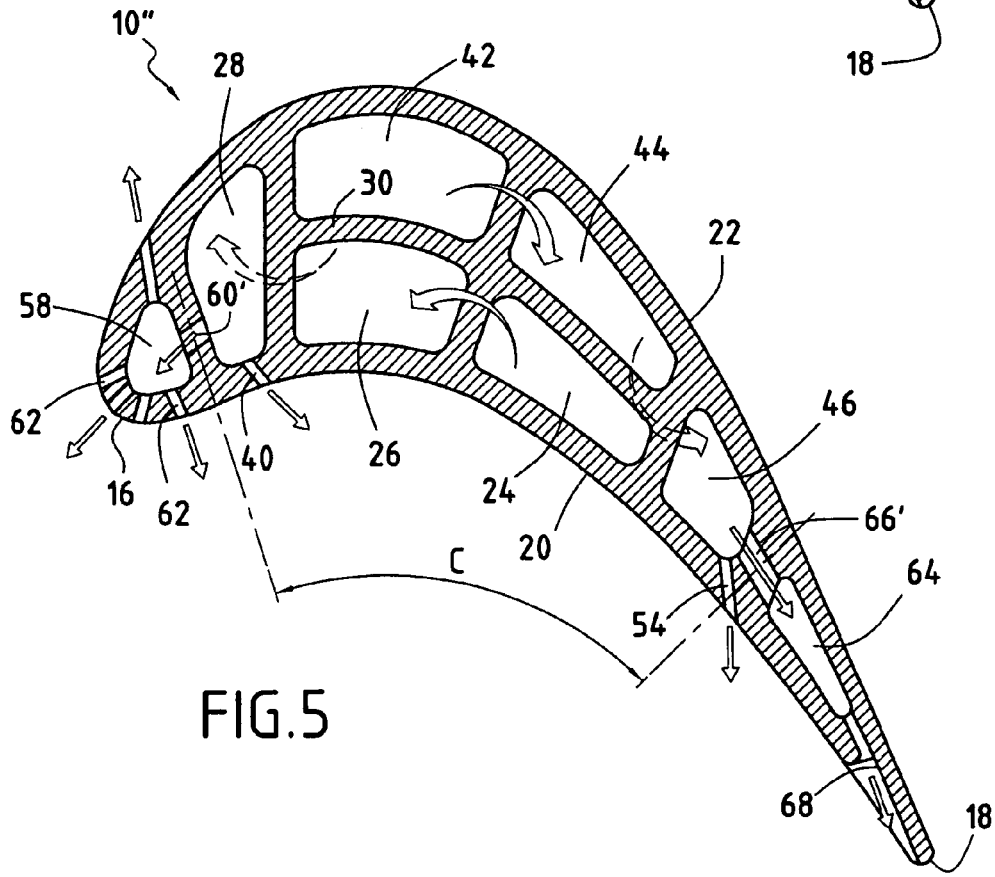

In yet another embodiment, shown in FIG. 5, the leading edge cooling circuit of the blade 10" has a plurality of air admission orifices 60' opening out into the leading edge cavity 58 and into the central cavity 28 of the pressure-side cooling circuit.

Similarly, the trailing edge cooling circuit of the blade 10" has a plurality of air admission orifices 66' opening out into the trailing edge cavity 64 from the central cavity 46 of the suction-side cooling circuit.

Thus, the cooling air feeding the leading edge and trailing edge circuits comes from the pressure-side and suction-side circuits respectively of the blade.

Compared with the embodiment of FIGS. 1 to 3, these variant embodiments for the blades 10' and 10" shown in FIGS. 4 and 5 do not have a central cavity in the leading edge and trailing edge cooling circuits. These embodiments are thus more particularly adapted to blades of chord shorter than the chord described with reference to FIGS. 1 to 3.

Compared with the embodiment of FIG. 4, the embodiment of FIG. 5 is also more specifically for a blade that is subjected to lower gas temperatures.

The cooling circuits of the invention present numerous advantages. In particular, the presence of a central wall situated along the skeleton in the central portion of the blade and cooled by the air traveling along the pressure-side and suction-side cavities of the pressure-side and suction-side circuits makes it possible to ensure that the blade is cooled effectively and uniformly. This leads to a considerable decrease in the mean temperature of the blade, thereby having the consequence of considerably increasing the lifetime of the blade, and thus of delaying blade replacement. The aerodynamic performance of the turbine fitted with such blades is not degraded by the presence of the cooling circuits. A blade provided with such cooling circuits can be fabricated by molding without presenting any additional particular problem.

The method of cooling blades in the invention also presents the advantage of being easily adapted to moving blades of the kind said to be of large "main cross-section". The main cross-section of a blade corresponds to the area of the largest circle that can be inscribed in the section of the blade. Thus, a blade presenting a large main cross-section can contain a circle of diameter that is larger than that of a blade presenting a standard main cross-section.

The invention claimed is:

1. A moving blade for a turbomachine, the blade being characterized in that its central portion (C) includes a pressure-side cooling circuit and a suction-side cooling circuit, said pressure-side cooling circuit comprising:

at least first and second pressure-side cavities extending radially and in the thickness direction of the blade from the pressure side of the blade to a central wall extending radially and along the skeleton direction of the blade;

a central cavity extending radially and in the thickness direction of the blade from the pressure side to the suction side of the blade;

an air admission opening at one radial end of the first pressure-side cavity for feeding the pressure-side circuit with air;

a first passage causing the other radial end of the first pressure-side cavity to communicate with a neighboring radial end of the second pressure-side cavity;

a second passage causing the other radial end of the second pressure-side cavity to communicate with a neighboring radial end of the central cavity; and outlet orifices opening out from the central cavity and into a pressure-side face of the blade;

the suction-side cooling circuit comprising:

at least first and second suction-side cavities extending radially and in the thickness direction of the blade from the suction side of the blade to said central wall;

a central cavity extending radially and in the thickness direction of the blade from the pressure side to the suction side of the blade;

an air admission opening at one radial end of the first suction-side cavity to feed the suction-side circuit with air;

a first passage causing the other radial end of the first suction-side cavity to communicate with a neighboring radial end of the second suction-side cavity;

a second passage causing the other radial end of the second suction-side cavity to communicate with a neighboring radial end of the central cavity; and outlet orifices opening out from the central cavity and into the pressure-side face of the blade.

2. A blade according to claim 1, further including a leading edge cooling circuit comprising at least one cavity extending radially in the vicinity of the leading edge of the blade, at least one air admission orifice opening out into the leading edge cavity, and outlet orifices opening out from said leading edge cavity and into the leading edge of the blade.

3. A blade according to claim 2, in which the air admission orifice is an opening situated at the radial end of the leading edge cavity.

4. A blade according to claim 2, in which the leading edge cooling circuit includes a plurality of air admission orifices opening out from the central cavity of the pressure-side cooling circuit and into the leading edge cavity.

5. A blade according to claim 2, in which the leading edge cooling circuit further includes a central cavity extending radially and in the thickness direction of the blade from the pressure side to the suction side of the blade, an opening at one radial end of the central cavity for feeding the circuit with air, and a plurality of air admission orifices opening out from the central cavity and into the leading edge cavity.

6. A blade according to any one of claims 1 to 5, further including a trailing edge cooling circuit comprising at least one cavity extending radially in the vicinity of the trailing edge of the blade, at least one air admission orifice opening out into the trailing edge cavity, and air outlet orifices opening out from the trailing edge cavity and into the pressure-side face of the blade.

7. A blade according to claim 6, in which the air admission orifice is a opening situated at the radial end of the trailing edge cavity.

8. A blade according to claim 6, in which the trailing edge cooling circuit includes a plurality of air admission orifices opening out from the central cavity of the suction-side cooling circuit and into the trailing edge cavity.

9. A blade according to claim 6, in which the trailing edge cooling circuit further includes a central cavity extending radially and across the blade from the pressure side to the suction side of the blade, an opening at a radial end of the central cavity for feeding the circuit with air, and a plurality of air admission orifices opening out from said central cavity and into the trailing edge cavity.

10. A blade according to claim 1, in which the internal walls of the cavities of the pressure-side and suction-side cooling circuits are provided with flow disturbers for increasing heat transfer along said walls.

* * * * *